US005669146A

United States Patent [19]

Beutler

[11] Patent Number: 5,669,146

[45] Date of Patent: Sep. 23, 1997

[54] CHANGEABLE INSERT PEEP SIGHT

[75] Inventor: Robert C. Beutler, Sand Creek, Mich.

[73] Assignee: Kenneth Robertson, Toledo, Ohio

[21] Appl. No.: 607,691

[22] Filed: Feb. 27, 1996

[51] Int. Cl.[6] ..... F41G 1/467

[52] U.S. Cl. ..... 33/265; 124/87; 124/90

[58] Field of Search ..... 124/87, 90; 33/265, 33/241

[56] References Cited

U.S. PATENT DOCUMENTS

| | | | |
|---|---|---|---|
| 3,410,644 | 11/1968 | McLendon | 124/87 X |
| 4,656,747 | 4/1987 | Troncoso | 124/90 X |
| 4,833,786 | 5/1989 | Shores, Sr. | 33/265 |
| 4,961,264 | 10/1990 | Topel | 124/90 X |
| 5,080,084 | 1/1992 | Kendall et al. | 124/87 |
| 5,137,007 | 8/1992 | Shoemake et al. | 124/87 |
| 5,148,603 | 9/1992 | Beutler | 33/265 |
| 5,325,598 | 7/1994 | Hall et al. | 124/87 X |
| 5,347,976 | 9/1994 | Saunders | 124/90 X |

*Primary Examiner*—Paul E. Shapiro
*Attorney, Agent, or Firm*—Howard & Howard

[57] ABSTRACT

A rear peep sight for use with an archery bow has a sighting body with front and rear surfaces joined by a side surface and a mounting groove formed in the side surface for retaining the sighting body on a bowstring. A sighting aperture and a plurality of locator apertures extend from the rear surface to a bottom surface of a cavity in the sighting body. An insert body in the cavity is formed of a light transmitting material for transmitting light incident at the front surface through the locator apertures to an eye of an archer located at the rear surface. The insert body is removably retained in the cavity by the bowstring such that it can be replaced by an insert body of a different color. Shutters formed on the sighting body rear surface, opaque areas on the insert body and shutter apertures are utilized to vary the amount of transmitted light reaching the eye of the archer.

20 Claims, 3 Drawing Sheets

CHANGEABLE INSERT PEEP SIGHT

BACKGROUND OF THE INVENTION

The present invention relates generally to an apparatus for archery bow sighting and, in particular, to a bow string mounted rear sight assembly.

An archer, operating a bow, mounts a nock of an arrow at a nocking point on a bowstring of the bow prior to drawing the bowstring. A shaft of the arrow is placed on an arrow rest position generally at a midpoint on one side of the bow. The archer then draws the bowstring back generally using the fingers of one hand while holding the bow with the opposite hand. Traditionally, to establish proper arrow trajectory once the bowstring is finally drawn, the archer typically placed the hand gripping the bowstring at a reference point on or near the archer's face and also aligned his eye directly behind a vertical plane passing through the side of the bow against which the arrow is rested and the drawn bowstring for target sighting.

Such a target sighting process was prone to error. To improve the accuracy and precision of the sighting process, bows and bowstrings were provided with various sighting devices to assist the archer in establishing proper arrow trajectory.

Such sighting devices have included sighting pins for installation on the bow and peep sights for installation in or on the bowstring. Sighting pins are adjustably mounted on and extend horizontally from the bow at a preset position above the arrow rest and are used in conjunction with a peep sight mounted in spaced relation above the nocking point so as to be in the line of sight of the archer. Thus, use of peep sights and sighting pins improve the archer's ability to establish proper arrow alignment and trajectory.

In low light conditions, however, target sights are difficult or impossible to use. One solution, associated with fire arms, has been to provide an illuminated sight. The U.S. Pat. No. 2,987,821, the U.S. Pat. No. 3,678,590 and the U.S. Pat. No. 3,914,873 disclose lighted sights for guns.

Lighted front sights and sighting pins have been used with bows. For example, the following U.S. Patent Nos. show lighted front sights for bows: U.S. Pat. No. 4,117,572; 4,215,484; 4,638,565; 4,689,887; 4,928,394; 4,953,302 and 4,977,677.

The traditional peep sights also have been difficult to use in low light conditions. Such peep sights are shown in the U.S. Pat. No. 3,703,770; the U.S. Pat. No. 3,703,771; the U.S. Pat. No. 3,859,733 and the U.S. Pat. No. 4,011,853.

Improvements in rear peep sights are shown in my U.S. Pat. No. 5,148,603 and my U.S. Pat. No. 5,157,839.

SUMMARY OF THE INVENTION

The present invention concerns an apparatus for use as a rear peep sight with an archery bow. The rear peep sight includes a sighting body having front and rear surfaces joined by a side surface, a mounting groove formed in the side surface for retaining the sighting body on a bowstring, a cavity formed in the sighting body open to the front surface and having a bottom surface, a sighting aperture formed in the sighting body extending from the rear surface to the bottom surface and a plurality of locator apertures formed in the sighting body extending from the rear surface to the bottom surface and positioned about the sighting aperture. The rear peep sight also includes an insert body removably retained in the sighting body cavity and being formed of a light transmitting material for transmitting light incident at the sighting body front surface through the locator apertures to an eye of an archer located at the sighting body rear surface. Removal of the insert body from said sighting body cavity is prevented by the bowstring when the sighting body and the insert body are mounted in the bowstring.

The sighting body can be formed of an opaque material and the insert body can be formed of a predetermined color light transmitting material. In one embodiment, the mounting groove is angled relative to the sighting body rear surface. In another embodiment, a portion of the sighting body cavity is open to the mounting groove for engaging the mounting means with the bowstring and the mounting means includes a radially outwardly extending flange formed on the insert body for engaging the bowstring.

The insert body can have a plurality of locator pins formed thereon, each of the locator pins extending through a corresponding one of the locator apertures when the insert body is retained in the sighting body cavity. A plurality of shutters can be formed on sighting body rear surface, each of the shutters being positioned adjacent one of the locator apertures whereby when the sighting body and the insert body are mounted in the bowstring, the shutters progressively obscure the locator apertures as the bowstring is drawn.

The sighting body cavity and the insert body can be generally cylindrical and the insert body can have a front surface with an actuator slot formed therein for rotating the insert body in the sighting body cavity. The insert body can have a rear surface with a plurality of opaque areas formed thereon whereby as the insert body is rotated in the cavity, the opaque areas progressively obscure the locator apertures. A window can be formed in the sighting body side surface extending to the cavity whereby light incident at the window is transmitted through the insert body to the locator apertures. The insert body can have a side surface with an opaque area formed thereon whereby as the insert body is rotated in the cavity, the opaque area progressively obscures the window.

A shutter wheel can be removably and rotatably retained in the sighting body cavity, the shutter wheel having a wheel aperture formed therein aligned with the sighting aperture and a plurality of different size shutter apertures formed therein and means for rotating the shutter wheel to align selected ones of the shutter apertures with the locator apertures. The means for rotating can include a lever arm extending from the shutter wheel and the sighting body can have an opening formed in the side wall, the lever arm extending through the opening. The lever arm can include a pin and the sighting body can have a plurality of stops formed adjacent the opening, the stops cooperating with the pin to releasably retain the shutter wheel in a plurality of positions to align the shutter apertures with the locator apertures.

The rear peep sight according to the present invention has the advantage of selective replacement of the insert body to change the color of the light transmitted to the eye of the archer. The rear peep sight according to the present invention also has the advantage of selective and progressive variation of the amount of the light transmitted to the eye of the archer.

BRIEF DESCRIPTION OF THE DRAWINGS

The above, as well as other advantages of the present invention, will become readily apparent to those skilled in the art from the following detailed description of a preferred embodiment when considered in the light of the accompanying drawings in which.

DESCRIPTION OF THE PREFERRED EMBODIMENT

Figure 1:
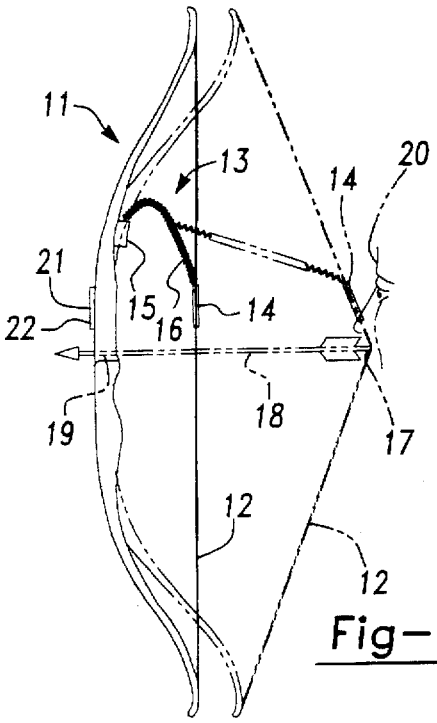
FIG. 1 is a side elevation view of an undrawn bow having a rear peep sight assembly in accordance with the present invention mounted on a bowstring.

There is shown in the FIG. 1 a bow 11 strung with a bowstring 12 and having a peep sight assembly 13 mounted thereon. The assembly 13 includes a rear peep sight 14 mounted on the bowstring 12, an attachment means 15 attached to a rearwardly facing surface of the bow 11 and a cord 16 connecting the rear peep sight with the attachment means. When the bowstring 12 is fully drawn, as shown in phantom, a nock 17 of an arrow 18 engages the bowstring. The shaft of the arrow 18 extends forward and rests against an arrow rest 19 on the bow 11. An archer 20 can sight through the rear peep sight 14 in order to align a target (not shown) with an appropriate pin 21 of a front sight 22 mounted on the front surface of the bow 11.

Figure 2:
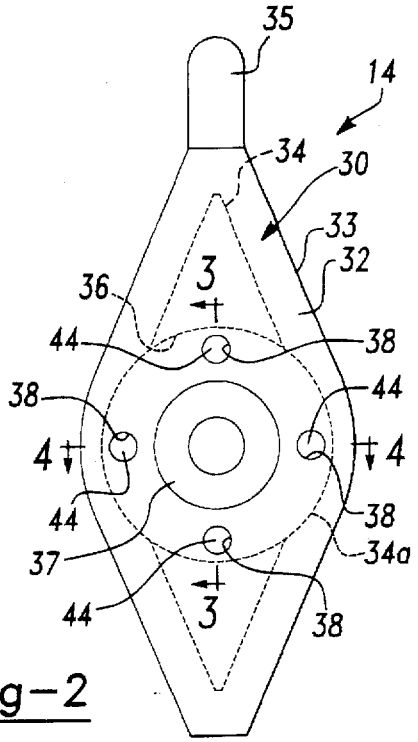
FIG. 2 is an enlarged rear elevation view of the rear peep sight shown in the FIG. 1.
Figure 3:
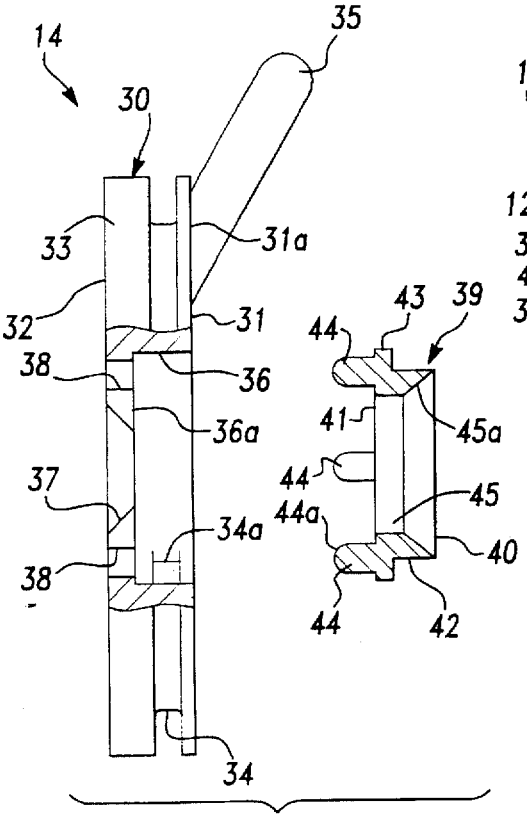
FIG. 3 is a right side elevation view in partial cross section of the rear peep sight taken along the line 3—3 in the FIG. 2 with the insert separated.
Figure 4:
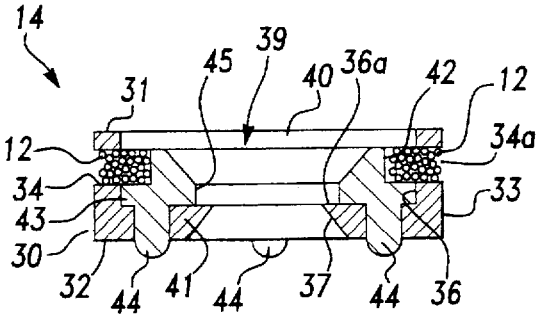
FIG. 4 is a cross-sectional view of the rear peep sight taken along the line 4—4 in the FIG. 2.

The rear peep sight 14 is shown in more detail in the FIGS. 2–4. The rear peep sight 14 includes a generally elliptical sighting body 30 which is wider in a central portion and narrower at upper and lower end portions. The body 30 has a generally planar front surface 31 spaced from and generally parallel to a generally planar rear surface 32. The surfaces 31 and 32 are connected by a side surface 33 extending completely around the body 30. A mounting groove in the form of a concave slot 34 is formed in the side surface 33 and extends around the body 30. The sighting body 30 is typically formed of an opaque material and the bowstring 12 is typically formed of a plurality of strands which can be separated into two generally equal size groups. As shown in the FIG. 4, the groups of strands of the bowstring 12 are inserted into the slot 34 to retain the body 30 in the bowstring 12. Extending outwardly and upwardly from an upper portion 31*a* of the front surface 31 is a post 35 which is utilized to attach one end of the cord 16 to the rear peep sight 14. For example, the cord 16 can be a hollow rubber tube having an inside diameter which is slightly smaller than the outside diameter of the post 35 such that when the post is inserted into one end of the tube, the tube and the rear peep sight are frictionally coupled together. The cord 16 and the post 35 are utilized to align the front surface 31 perpendicular to the longitudinal axis of the arrow 18 when the bow 11 is drawn.

There is formed in the sighting body 30 a generally circular cavity 36 which is open at the front surface 31 and extends beyond the concave slot 34 into the body to a generally planar bottom surface 36*a* spaced from the rear surface 32. A sighting aperture 37 is formed in the sighting body 30 and extends from the rear surface 32 to the bottom surface 36*a* of the cavity 36. Thus, there is an unobstructed view for the archer 20 from the rear surface 32 to the front surface 31 through the sighting aperture 37 and the cavity 36. The sighting aperture 37 is tapered from a larger diameter at the rear surface 32 to a smaller diameter at the juncture with the bottom surface 36*a* of the cavity 36. Also formed in the sighting body 30 is a plurality of locator apertures 38 which are smaller in diameter than and are located equidistant from the sighting aperture 37. Although four locator apertures 38 are shown, more or less could be utilized. The locator apertures 38 extend from the rear surface 32 to the bottom surface 36*a* of the cavity 36.

The rear peep sight 14 also includes an insert body 39 which is generally cylindrical in shape and has a generally planar front surface 40 extending generally parallel to a spaced apart generally planar rear surface 41. The front surface 40 and the rear surface 41 are connected by a side surface 42 extending about the periphery of the insert body 39. Extending outwardly from the side surface 42 is a mounting means in the form of an annular flange 43 which is formed adjacent the rear surface 41. Extending outwardly from the rear surface 41 is a plurality of locator pins 44. The diameter of the flange 43 is slightly smaller than the diameter of the cavity 36 such that when the insert body 39 is inserted into the cavity with the rear surface 41 abutting the bottom surface 36*a*, each of the locator pins 44 extends through a corresponding one of the locator apertures 38. Each of the locator pins 44 has a rounded outer end 44*a* which extends beyond the rear surface 32. However, the pins 44 can be shorter so that they do not extend beyond the rear surface 42. While the insert body 39 is in the cavity 36, the rear peep sight 14 can be installed in the bowstring 12 as shown in the FIG. 4. The diameter of the cavity 36 is greater than the spacing between the bottom surfaces of the slot 34 at a central portion of the body 30 such that openings 34*a* to the cavity are formed in the side surface 33. Individual strands of the bowstring 12 are received in the concave slot 34 and are forced into the openings 34*a* so as to engage the facing surface of the flange 43 and the side surface 42. The strands of the bowstring 12 thus retain the insert body 39 in the cavity 36. The insert body 39 has an insert aperture 45 formed therein generally concentric with the sighting aperture 37 when the insert body is in the cavity 36. The insert aperture 45 has a front tapered portion 45*a* which tapers from a smaller diameter internal of the body 39 to a larger diameter at the front surface 40. Typically, the insert body 39 is formed of a light transmitting transparent or translucent material such that light incident at the front surface 40 is transmitted through the insert body to the ends 44*a* of the locator pins 44 where such light can be observed by the archer 20. The rear peep sight 14 is especially useful in low light conditions when it is difficult for the archer 20 to see whether a sighting aperture, such as the sighting aperture 37, is aligned properly with a target. Ambient light is transmitted through the insert body 39 and is concentrated in the locator pin ends 44*a* provide visible reference points for the archer 20 who knows that the center of the sighting aperture 37 is centered with respect to the locator pins 44.

As the bow 11 is drawn, as shown in the FIG. 1, the rear peep sight 14 is moved away from a generally vertical plane to a plane angled with respect to the line of sight of the archer 20. As this angle from the vertical is increased, the vertical distances between the top and bottom of the sighting aperture 37 and the locator apertures 38 is decreased. The rounded ends 44*a* of the locator pins 44, which extend beyond the rear surface 32 of the sighting body 30, continue to be visible as this angle is increased.

Figure 5:
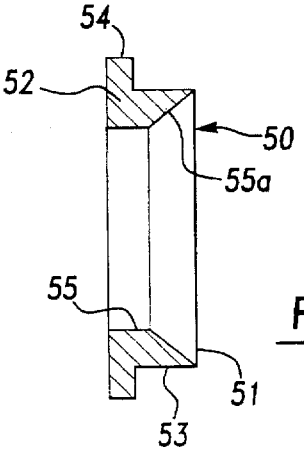
FIG. 5 is a cross-sectional view of an alternate embodiment insert for use in the rear peep sight shown in the FIG. 2.

There is shown in the FIG. 5 an alternate embodiment of the insert body 39. A generally cylindrical insert body 50 has a generally planar front surface 51 spaced from and extending generally parallel to a generally planar rear surface 52. The surfaces 51 and 52 are connected by a side surface 53 which extends about a periphery of the body 50. An outwardly extending flange 54 is formed on the side surface 53 adjacent the rear surface 52. A centrally located insert aperture 55 is formed through the insert body 50 between the front surface 51 and the rear surface 52. The insert aperture 55 has a tapered portion 55*a* which tapers from a smaller diameter internal of the body 50 to a larger diameter at the front surface 51. Thus, the insert body 50 is similar to the insert body 39 with the exception that the locator pins 44 have been eliminated. Accordingly, the light transmitted through the insert body 50 will be gradually diminished as the bow 11 is drawn since the locator apertures 38 are being angled to reduce the vertical height with respect to the line of sight of the archer 20.

Figure 6:
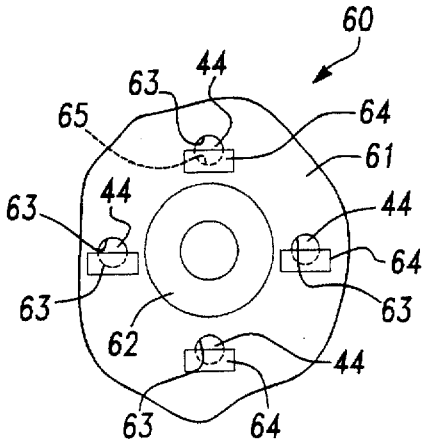
FIG. 6 is an enlarged fragmentary rear elevation view of the an alternate embodiment sighting body for use with the rear peep sight shown in the FIG. 2.
Figure 7:
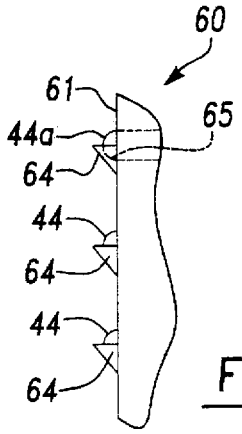
FIG. 7 is an enlarged fragmentary right side elevation view of the alternate embodiment sighting body shown in the FIG. 6.

There is shown in the FIG. 6 and in the FIG. 7 an alternate embodiment of the rear peep sight 14. A sighting body 60, similar to the sighting body 30, has a generally planar rear surface 61 with a sighting aperture 62 formed therein surrounded by locator apertures 63. Extending from the rear surface 61 through the locator apertures 63 are the locator pins 44 of the insert body 39 shown in the FIG. 3. Extending outwardly from the rear surface 61 are a plurality of shutters 64. Each of the shutters 64 extends across and is aligned with a lower portion of a corresponding one of the locator apertures 63. Each of the shutters 64 also has an upwardly and forwardly facing recess 65 formed therein for receiving the outer end 44*a* of the locator pin 44. Thus, as the sighting body 60 is tilted when the bowstring 12 is drawn, each of the shutters 64 will progressively obscure an increasingly larger portion of the rounded end 44*a* of the corresponding locator pin 44 and the locator aperture 63 to decrease the amount of light transmitted to the view of the archer 20.

Figure 8:
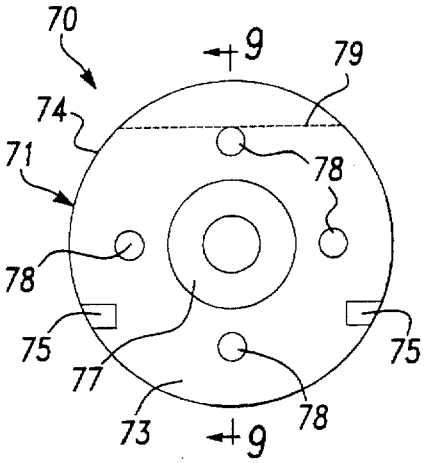
FIG. 8 is an enlarged rear elevation view of an alternate embodiment rear peep sight according to the present invention.
Figure 9:
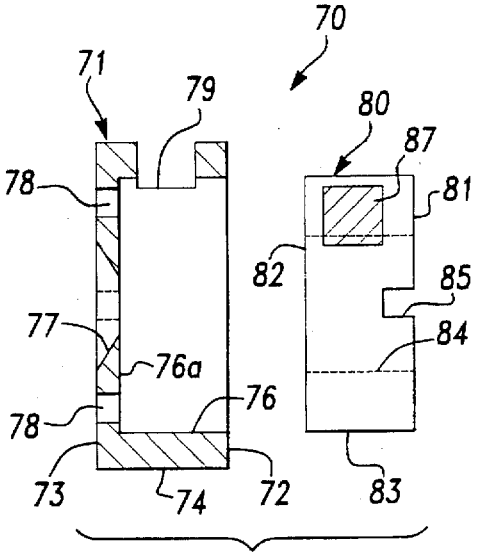
FIG. 9 is a cross-sectional view of the rear peep sight taken along the line 9—9 in the FIG. 8 with the insert separated.
Figure 10:
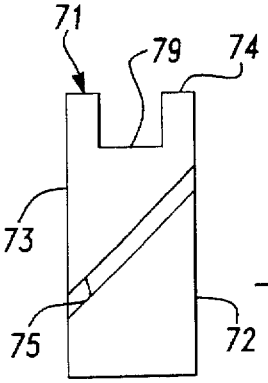
FIG. 10 is a right side elevation view of the sighting body of the rear peep sight shown in the FIG. 8.
Figure 11:
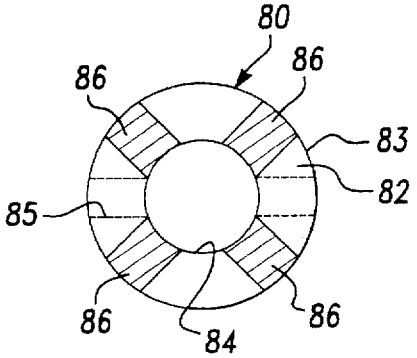
FIG. 11 is a rear elevation view of the insert body shown in the FIG. 9.

There is shown in the FIG. 8 through the FIG. 11 an alternate embodiment of the peep sight assembly according to the present invention. A rear peep sight 70 includes a generally cylindrical sighting body 71 having a generally planar front surface 72 spaced from and generally parallel to a generally planar rear surface 73. The front surface 72 and the rear surface 73 are joined by a side surface 74. A pair of concave slots 75 are formed in the side surface 74 diametrically opposite one another and are angled with respect to the rear surface 73 of the body 71. The body 71 has a generally cylindrical cavity 76 formed therein having a bottom surface 76*a* and being open to the front surface 72. The bottom surface is generally planar and is spaced from and generally parallel to the rear surface 73. A sighting aperture 77 is formed in the body 71 and extends from the rear surface 73 to the bottom surface 76*a*. The sighting aperture 77 tapers from a larger diameter at the rear surface 73 to a smaller diameter at the bottom surface 76*a*. A plurality of locator apertures 78 are formed in the body 71 between the rear surface 73 and the bottom surface 76*a*. The locator apertures 78 are spaced about the sighting aperture 77 equidistant from the center thereof. A window 79 is formed in the side wall 74 in an upper portion of the body 71 and is open to the cavity 76.

The rear peep sight 70 also includes a generally cylindrical insert body 80 having a generally planar front surface 81 spaced from and generally parallel to a generally planar rear surface 82. The front surface 81 and the rear surface 82 are connected by a side surface 83 extending about a periphery of the body 80. A centrally located insert aperture 84 extends between the front surface 81 and the rear surface 82. An actuator slot 85 is formed in the front surface 81 and extends diametrically. The actuator slot 85 is sized to receive a standard coin such as a dime for purposes of rotation of the insert body 80 as discussed below. A plurality of opaque areas 86 are formed on the rear surface 82 in a spaced relationship corresponding to the positioning of the locator apertures 78 formed in the sighting body 71. The rear peep sight 70 is assembled by inserting the insert body 80 into the cavity 76 such that the rear surface 82 abuts the bottom surface 76*a* of the cavity. When the bowstring 12 (FIG. 1) is inserted into the slots 75, a portion of the bowstring extends in front of the front surface 81 to prevent the insert body 80 from being removed from the cavity 76. Typically, the sighting body 71 is formed of an opaque material and the insert body 80 is formed of a light transmitting material. When the insert body 80 is aligned such that the slot 85 extends in a generally horizontal direction, the opaque areas 86 are located between the locator apertures 78. Thus, light incident on the front surface 81 of the insert body 80 and light incident on the side surface 83 through the window 79 is transmitted through the insert body to the locator apertures 78. The amount of light reaching the locator apertures 78 can be controlled or completely blocked by inserting a coin in the slot 85 and rotating the insert body 80 relative to the sighting body 71 such that the opaque areas 86 partially or completely block corresponding ones of the locator apertures 78. In addition, another opaque area 87 can be formed on the side surface 83 for alignment with the window 79 as the insert body 80 is rotated. The opaque areas 86 and 87 can be formed by any suitable means such as by painting or hot stamping and can be of any suitable shape.

Figure 12:
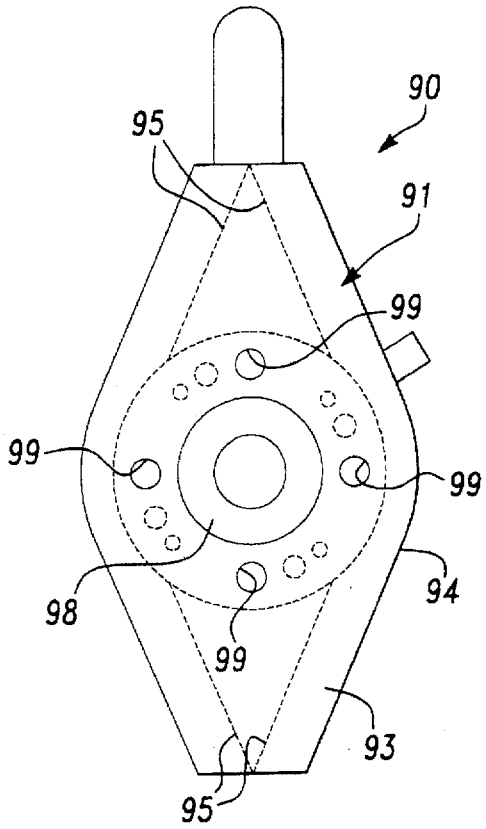
FIG. 12 is an enlarged rear elevation view of another alternate embodiment rear peep sight according to the present invention.
Figure 13:
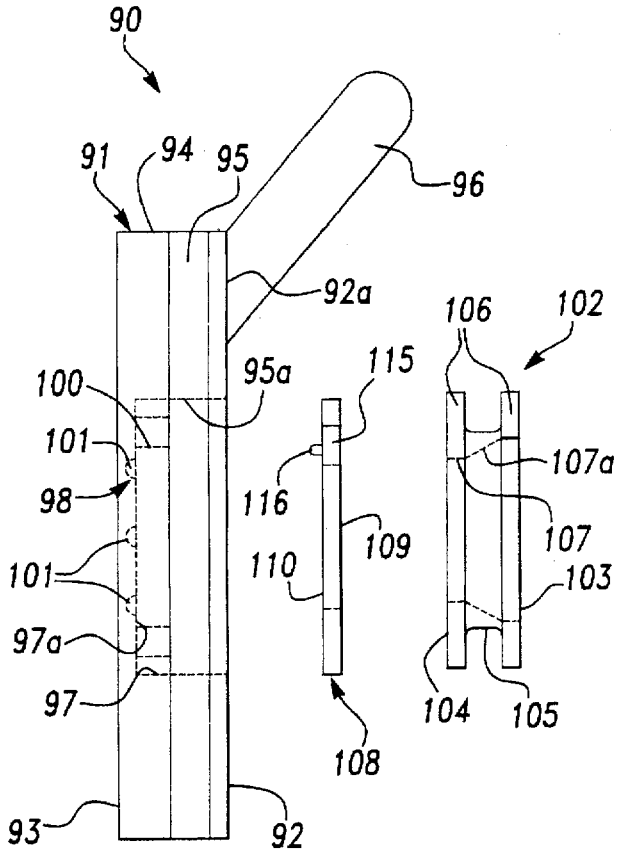
FIG. 13 is a cross-sectional view of the rear peep sight taken along the line 13—13 in the FIG. 12 with the shutter wheel and the insert separated.
Figure 14:
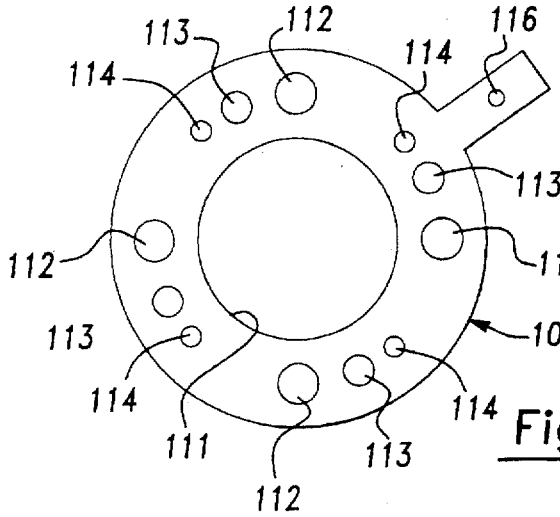
FIG. 14 is a rear elevation view of the shutter wheel shown in the FIG. 13.

There is shown in the FIG. 12 through the FIG. 14 another alternate embodiment rear peep sight 90 according to the present invention. The rear peep sight 90 includes a sighting body 91 having a generally planar front surface 92 spaced from and generally parallel to a generally planar rear surface 93. The front surface 92 and the rear surface 93 are joined by a side surface 94. A generally concave slot 95 is formed in the side surface 94 for accepting the strands of the bowstring 12. An outwardly and upwardly extending post 96 is attached to an upper portion 92*a* of the front surface 92. Formed in the sighting body 91 is a generally cylindrical cavity 97 open to the front surface 92 and extending inwardly to a generally planar bottom surface 97*a* spaced from the rear surface 93. A sighting aperture 98 is formed in the sighting body 91 and extends from the rear surface 93 to the bottom surface 97*a*. The sighting aperture 98 is tapered from a larger diameter at the rear surface 93 to a smaller diameter at the juncture with the bottom surface 97*a* of the cavity 97. Positioned about the sighting aperture 98 is a plurality of locator apertures 99 which also extend from the rear surface 93 to the bottom surface 97*a* of the cavity 97.

The diameter of the cavity 97 is greater than the spacing between the bottom surfaces of the slots 95 at a central portion of the body 91 such that openings 95*a* to the cavity are formed in the side surface 94. Another opening 100 is formed in the side surface 94 adjacent one of the openings 95*a* and extends to the cavity 97*a*. A plurality of depressions or stops 101 are formed in a side wall of the opening 100. The rear peep sight 90 also includes an insert body 102 having a generally planar front surface 103 spaced from and generally parallel to a generally planar rear surface 104. The front surface 103 and the rear surface 104 are joined by a side surface 105 extending about a periphery of the body 102. A pair of radially outwardly extending flanges 106 of approximately the same diameter as the cavity 97 are formed at the surfaces 103 and 104 to define a groove therebetween for receiving the bowstring. Thus, the pair of flanges 106 with the groove therebetween are an alternative to the single flanges 43 and 54 for retaining the insert body 102. An insert aperture 107 is formed through the insert body 102 between the front surface 103 and the rear surface 104. The insert aperture 107 includes a tapered portion 107*a* which tapers from a smaller diameter internal of the body 102 to a larger diameter at the front surface 103.

Also included in the rear peep sight 90 is a shutter wheel 108 of approximately the same diameter as the cavity 97*a*. The shutter wheel 108 includes a generally planar front surface 109 spaced from and extending generally parallel to a generally planar rear surface 110. A wheel aperture 111 is formed through the shutter wheel 108 between the front surface 109 and the rear surface 110 and is positioned generally centrally. A plurality of larger diameter shutter apertures 112 extend between the front surface 109 and the rear surface 110 and are positioned to be aligned with the locator apertures 99 when the shutter wheel 108 is positioned in the cavity 97. The apertures 112 are approximately the same diameter as the locator apertures 99. Adjacent each of the larger diameter shutter apertures 112 is medium diameter shutter aperture 113 and adjacent each of the medium diameter shutter apertures is a smaller diameter shutter aperture 114.

Extending radially outwardly from the periphery of the shutter wheel 108 is a lever arm 115. A pin 116 is formed on a rear surface of the arm 115. When the wheel 108 is inserted into the cavity 97, the lever arm 115 extends through the opening 100. The insert body 102 is then placed into the cavity 97 and the slot 95 receives the strands of the bowstring 12 to retain both the shutter wheel 108 and the insert body in the cavity. Friction between the rear surface 110 of the shutter wheel 108 and the bottom surface 97*a* of the cavity 97 and between the front surface 109 and the rear surface 104 of the insert body 102 can be sufficient to prevent the shutter wheel from rotating in the cavity. However, the pin 116 is positioned on the lever arm 115 for engaging the stops 101 whereby a selected one of the apertures 112, 113 and 114 can be aligned with a corresponding one of the locator apertures 99. Forwardly directed pressure on the lever arm 115 will cause the pin 116 to disengage from the selected one of the stops 101 to permit the shutter wheel 108 to rotate.

Typically, the insert bodies 39, 50, 80 and 102 are formed of a light transmitting material which can be colored or tinted to provide a significant contrast with the opaque sighting bodies. Since the insert bodies are removable from the sighting bodies, the color and degree of tint can be selected by the archer even during use of the rear peep sight simply by replacing one insert body with another of a different color or tint. Thus, the archer can adjust the rear peep sight to accommodate changing light conditions in the field.

In accordance with the provisions of the patent statutes, the present invention has been described in what is considered to represent its preferred embodiment. However, it should be noted that the invention can be practiced otherwise than as specifically illustrated and described without departing from its spirit or scope.

What is claimed is:

1. A rear peep sight for use with an archery bow comprising:

a sighting body having front and rear surfaces joined by a side surface, a cavity formed in said sighting body open to said sighting body front surface and having a bottom surface, a mounting groove formed in said sighting body side surface for retaining said sighting body on a bowstring and having a bottom surface, a sighting aperture formed in said sighting body extending from said sighting body rear surface to said cavity bottom surface and a plurality of locator apertures formed in said sighting body extending from said sighting body rear surface to said cavity bottom surface and positioned about said sighting aperture;

an insert body having front and rear surfaces joined by a side surface and being removably retained in said sighting body cavity, said insert body rear surface facing said cavity bottom surface and overlapping said locator apertures, said insert body being formed of a light transmitting material for transmitting light incident on said insert body front surface to said insert body rear surface; and means for causing a portion of a bowstring to block removal of said insert body from said sighting body when said sighting body is mounted on the bowstring with said insert body located in said sighting body cavity and with a portion of said bowstring inserted into said mounting groove whereby when said sighting body with said insert body located therein is mounted on a bowstring light incident on said insert body front surface is transmitted through said insert body to said locator apertures and to an eye of an archer located at said sighting body rear surface.

2. The rear peep sight according to claim 1, wherein said sighting body is formed of an opaque material.

3. The rear peep sight according to claim 1 wherein said means for causing comprises said mounting groove being angled relative to said sighting body rear surface and intersecting said sighting body front surface.

4. The rear peep sight according to claim 1 wherein said means for causing comprises an opening in said mounting groove bottom surface open to said sighting body cavity for engaging said insert body side surface with the bowstring.

5. The rear peep sight according to claim 4 wherein said means for causing further comprises insert body side surface having a radially outwardly extending flange formed thereon aligned with and behind said opening in said mounting groove bottom surface for engaging the bowstring.

6. The rear peep sight according to claim 1 wherein said locator apertures are positioned equidistant from said sighting aperture.

7. The rear peep sight according to claim 1 wherein said insert body is formed of a predetermined color light transmitting material.

8. The rear peep sight according to claim 1 wherein said insert body rear surface has a plurality of locator pins formed thereon, each of said locator pins being formed of a light transmitting material and extending through a corresponding one of said locator apertures when said insert body is retained in said sighting body cavity.

9. The rear peep sight according to claim 1 including a plurality of shutters formed on said sighting body rear surface, each of said shutters being positioned adjacent one of said locator apertures whereby when said sighting body and said insert body are mounted in the bowstring, said shutters progressively obscure said locator apertures as the bowstring is drawn.

10. The rear peep sight according to claim 1 wherein said sighting body cavity and said insert body are generally cylindrical and said insert body front surface has an actuator slot formed therein for rotating said insert body in said sighting body cavity.

11. The rear peep sight according to claim 10 wherein said insert body rear surface has a plurality of opaque areas formed thereon whereby as said insert body is rotated in said sighting body cavity, said opaque areas progressively obscure said locator apertures.

12. The rear peep sight according to claim 1 including a window formed in said sighting body side surface and extending to said sighting body cavity whereby light incident at said window is transmitted through said insert body to said locator apertures.

13. The rear peep sight according to claim 12 wherein said insert body side surface has an opaque area formed thereon whereby as said insert body is rotated in said sighting body cavity, said opaque area progressively obscures said window.

14. The rear peep sight according to claim 1 including a shutter wheel removably and rotatably retained in said sighting body cavity, said shutter wheel having a wheel aperture formed therein aligned with said sighting aperture, a plurality of different size shutter apertures formed therein and means for rotating said shutter wheel thereon for aligning selected ones of said shutter apertures with said locator apertures.

15. The rear peep sight according to claim 14 wherein said means for rotating includes a lever arm extending from said shutter wheel and said sighting body side wall has an opening formed therein, said lever arm extending through said sighting body side wall opening.

16. The rear peep sight according to claim 15 wherein said lever arm includes a pin and said sighting body has a plurality of stops formed adjacent said sighting body side wall opening, said stops cooperating with said pin to releasably retain said shutter wheel in a plurality of positions to align said shutter apertures with said locator apertures.

17. A rear peep sight for use with an archery bow comprising:

a sighting body having spaced apart, generally parallel and planar front and rear surfaces joined by a side surface, a cavity formed in said sighting body open to said sighting body front surface and having a bottom surface, a mounting groove formed in said sighting body side surface for retaining said sighting body on a bowstring and having a bottom surface, a sighting aperture formed in said sighting body extending from said sighting body rear surface to said cavity bottom surface and a plurality of locator apertures formed in said sighting body equidistant from said sighting aperture and extending from said sighting body rear surface to said cavity bottom surface;

an insert body having front and rear surfaces joined by a side surface and being removably retained in said sighting body cavity, said insert body rear surface facing said cavity bottom surface and overlapping said locator apertures, said insert body being formed of a predetermined color light transmitting material for transmitting light incident on said insert body front surface to said insert body rear surface; and means for causing a portion of a bowstring to block removal of said insert body from said sighting body when said sighting body is mounted on the bowstring with said insert body located in said sighting body cavity and with a portion of said bowstring inserted into said mounting groove whereby when said sighting body with said insert body located therein is mounted on a bowstring light incident on said insert body front surface is transmitted through said insert body to said locator apertures and to an eye of an archer located at said sighting body rear surface.

18. A rear peep sight for use with an archery bow comprising:

a sighting body having spaced apart, generally parallel and planar front and rear surfaces joined by a side surface, a cavity formed in said sighting body open to said sighting body front surface and having a bottom surface, a mounting groove formed in said sighting body side surface for retaining said sighting body on a bowstring and having a bottom surface, a sighting aperture formed in said sighting body extending from said sighting body rear surface to said cavity bottom surface and a plurality of locator apertures formed in said sighting body in predetermined locations relative to said sighting aperture and extending from said sighting body rear surface to said cavity bottom surface;

an insert body having front and rear surfaces joined by a side surface and being removably retained in said sighting body cavity, said insert body rear surface facing said cavity bottom surface and overlapping said locator apertures, said insert body being formed of a light transmitting material for transmitting light incident on said insert body front surface to said insert body rear surface; means for causing a portion of a bowstring to block removal of said insert body from said sighting body when said sighting body is mounted on the bowstring with said insert body located in said sighting body cavity and with a portion of said bowstring inserted into said mounting groove whereby when said sighting body with said insert body located therein is mounted on a bowstring light incident on said insert body front surface is transmitted through said insert body to said locator apertures and to an eye of an archer located at said sighting body rear surface; and a shutter means formed on at least one of said sighting body and said insert body for varying an amount of the light transmitted to the eye of the archer.

19. The rear peep sight according to claim 18 wherein said shutter means is a plurality of shutters formed on said sighting body rear surface, each of said shutters being positioned adjacent one of said locator apertures whereby when said sighting body and said insert body are mounted in the bowstring, said shutters progressively obscure said locator apertures as the bowstring is drawn.

20. The rear peep sight according to claim 19 wherein said shutter means is a plurality of opaque areas formed on said insert body rear surface whereby as said insert body is rotated in said sighting body cavity, said opaque areas progressively obscure said locator apertures.

* * * * *